US005669837A

United States Patent [19]

Hauter

[11] Patent Number: 5,669,837

[45] Date of Patent: Sep. 23, 1997

[54] SOCCER TRAINING APPARATUS

[76] Inventor: Bradley David Hauter, 433 Harvest Gate, Lake In The Hills, Ill. 60102

[21] Appl. No.: 740,625

[22] Filed: Oct. 31, 1996

Related U.S. Application Data

[60] Division of Ser. No. 591,755, Jan. 25, 1996, which is a continuation-in-part of Ser. No. 510,357, Aug. 2, 1995, Pat. No. 5,586,760, which is a continuation-in-part of Ser. No. 273,761, Jul. 12, 1994, Pat. No. 5,443,576.

[51] Int. Cl.[6] ..... A63B 67/10

[52] U.S. Cl. ..... 473/576; 273/DIG. 19; 273/DIG. 30

[58] Field of Search ..... 273/58 C, DIG. 30, 273/DIG. 17–19, 413, 414, 26 R, 26 C, 1.5 A, 29 A; 434/251

[56] References Cited

U.S. PATENT DOCUMENTS

| | | | |
|---|---|---|---|
| 667,563 | 2/1901 | Oekley . | |
| 3,224,774 | 12/1965 | Klotz . | |
| 3,655,190 | 4/1972 | Lemon | 273/414 |
| 3,782,727 | 1/1974 | Chirnomas . | |
| 3,863,924 | 2/1975 | Gagnon . | |
| 4,003,575 | 1/1977 | Hobbs . | |
| 4,021,035 | 5/1977 | O'Hara | 273/DIG. 19 |
| 4,042,241 | 8/1977 | Collins . | |
| 4,059,271 | 11/1977 | Depre . | |
| 4,071,241 | 1/1978 | Cortes Garcia . | |
| 4,121,822 | 10/1978 | DiSabatino . | |
| 4,145,046 | 3/1979 | Jones . | |
| 4,156,574 | 5/1979 | Boden . | |
| 4,240,629 | 12/1980 | Song et al. | 273/58 C |
| 4,248,423 | 2/1981 | Lotfy | 273/58 C |
| 4,375,886 | 3/1983 | Muys | 273/58 C |
| 4,400,907 | 8/1983 | Alter et al. . | |
| 4,473,928 | 10/1984 | Johnson | 24/483 |
| 4,687,209 | 8/1987 | Carey . | |
| 4,836,555 | 6/1989 | Wexler | 273/414 |
| 4,871,118 | 10/1989 | Diaz . | |
| 4,960,280 | 10/1990 | Corder, Jr. | 273/DIG. 30 |
| 5,080,376 | 1/1992 | Lerner et al. . | |
| 5,094,462 | 3/1992 | Boyle et al. . | |
| 5,165,696 | 11/1992 | Saha . | |
| 5,199,715 | 4/1993 | May . | |
| 5,244,206 | 9/1993 | Clark et al. . | |
| 5,358,258 | 10/1994 | Killion | 273/29 A |
| 5,443,576 | 8/1995 | Hauter | 273/58 C |

*Primary Examiner*—Steven B. Wong
*Attorney, Agent, or Firm*—Meroni & Meroni

[57] ABSTRACT

A soccer training apparatus is provided. The apparatus has a mesh soccer net sized and configured for encapsulating a soccer ball and loosely holding the soccer ball within the mesh soccer net enabling the encapsulated soccer ball to freely rotate within. A waist belt is adapted for securement around a waist of a user. A cord has a first portion attached to the mesh soccer net and a second portion connected to a hand grip. The hand grip is removably connected with the waist belt.

10 Claims, 6 Drawing Sheets

Fig. 10
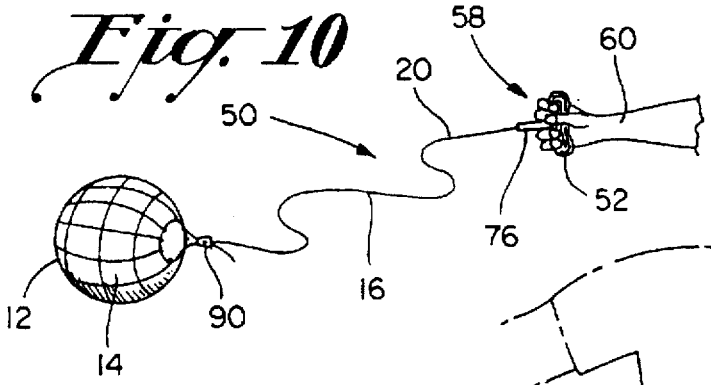
Fig. 11
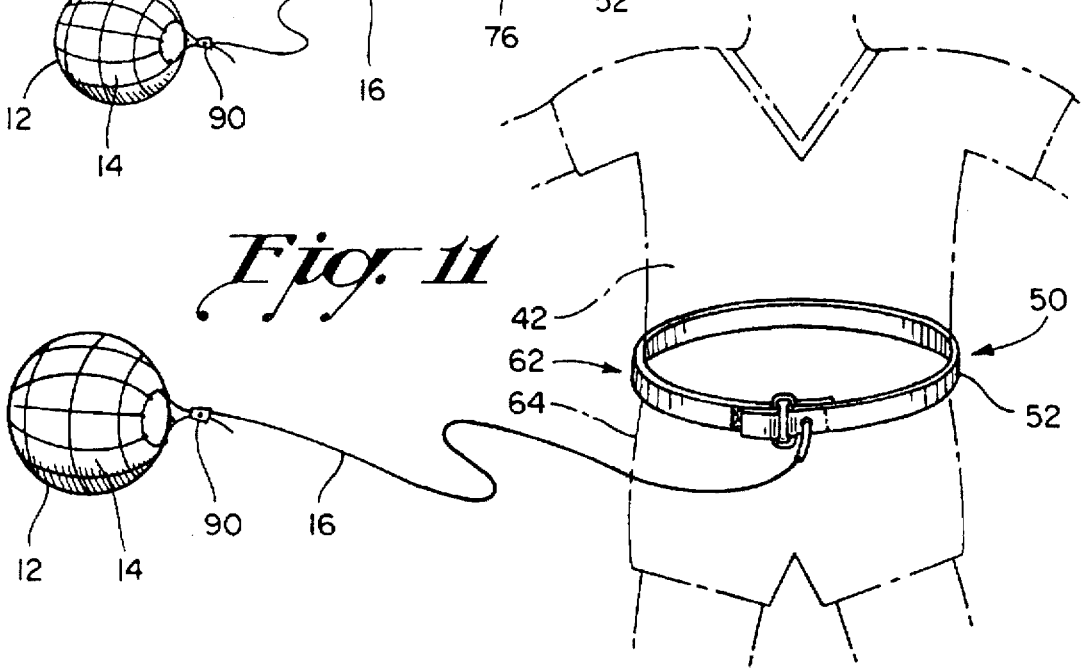
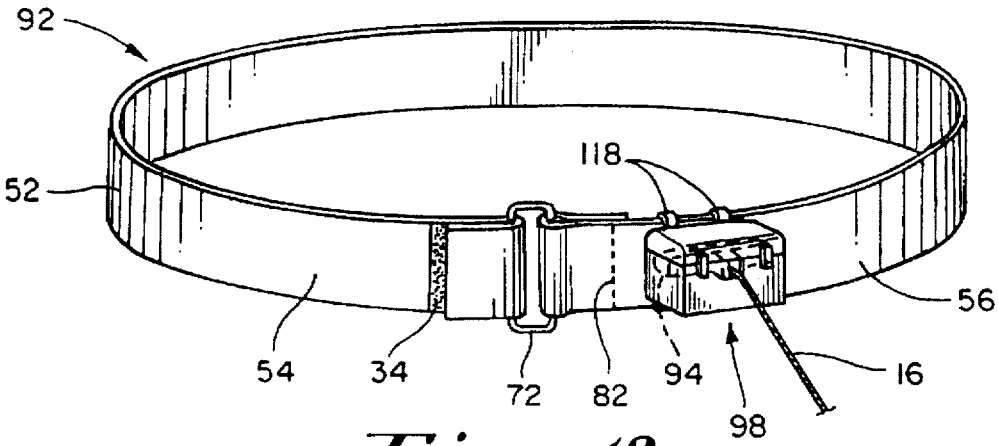
Fig. 12

SOCCER TRAINING APPARATUS

TECHNICAL FIELD

This is a divisional of Ser. No. 08/591,755 filed Jan. 25, 1996, which was a continuation-in-part of Ser. No. 08/510,357 filed Aug. 2, 1995, now U.S. Pat. No. 5,586,760, which was a continuation-in-part of Ser. No. 08/273,761 filed Jul. 12, 1994, now U.S. Pat. No. 5,443,576.

The present invention relates generally to a soccer training device, and more particularly, to a soccer training belt for use with a cord suspended soccer ball.

BACKGROUND ART

Many different types of soccer training devices are known in the art. An important object of these devices is to provide a way for an individual to practice his or her soccer technique alone.

U.S. Pat. No. 5,094,462 issued to Boyle et al., discloses a soccer training device having a net which holds a soccer ball. An elastic cord is connected to the net on one end and is connected to a wrist or ankle strap on the other end. This invention, however, suffers from a number of disadvantages. The use of an elastic cord allows a returning soccer ball to gain in speed making it difficult for younger players to develop their technique. The use of a wrist or ankle strap will provide for an untrue return of the soccer ball due to an increased human variability in the changing positioning of a player's arms or legs. In addition, the length of elastic cord is not adjustable for allowing a player to have varied positioning and distance with the soccer ball.

U.S. Pat. No. 4,042,241 issued to Collins, discloses a soccer training device having elastic cord which is attached at one end to a soccer ball and at its other end to a flexible loop which fits around the foot, head or neck. Like the device by Boyle et al., the use of elastic cord creates a disadvantage for younger players. In addition, the Collins device attaches the elastic cord directly to the soccer ball. This form of attachment suffers from a number of disadvantages. The point of attachment creates a knob like structure on the ball which will prevent the ball from flying straight and returning straight. The natural rotational forces of a kicked ball will be hindered because the ball is directly connected to the cord. If a player where to kick the ball at the point of attachment, the knob like structure would prevent the player from obtaining a natural kick. In a worst case, the player could injure his or her foot.

U.S. Pat. No. 5,080,376 issued to Lerner et al. and U.S. Pat. No. 4,687,209 issued to Carey, disclose soccer training devices. Both devices suffer from some the same disadvantages previously stated in that the devices have a tether which is secured directly to the ball and do not allow for adjustability in the length of the tether. For example, Lerner attaches a tether cord to the ball with a stud having an enlarged head, which prevents natural rotation of the ball and creates a safety hazard if the foot of a player comes in direct contact with the stud.

A more desirable soccer training device is one which would allow for a more true or natural kick of the ball, would be applicable for players of all ages and skill levels, and would provide a more consistent return location of the ball.

DISCLOSURE OF INVENTION

Accordingly, it is an object of this invention to provide a soccer training apparatus which does not restrict the arms or legs of a player during ball dribbling or juggling.

Another object of the present invention is to provide a soccer training apparatus which will provide a truer and more natural kick and flight of a ball.

Another object of the present invention is to provide a soccer training apparatus that can be selectively worn around the waist of a player or held in the hand of a player.

Still another object of the present invention is to provide a soccer training apparatus which will allow a player to adjust the length of an attached cord.

Yet another object of the present invention is to provide a soccer training apparatus which has a waist belt that is adjustable and easy to secure for use by players of all sizes and shapes.

To achieve the foregoing and other objectives, and in accordance with the purposes of the present invention a soccer training apparatus is provided. The apparatus has a mesh soccer net sized and configured for encapsulating a soccer ball and loosely holding the soccer ball within the mesh soccer net enabling the encapsulated soccer ball to freely rotate within. A waist belt is adapted for securement around a waist of a user. A cord has a first portion attached to the mesh soccer net and a second portion connected to a hand grip. The hand grip is detachably secured to the waist belt.

Other objects, features and advantages of my invention will become more readily apparent upon reference to the following description when taken in conjunction with the accompanying drawings.

BRIEF DESCRIPTION OF DRAWINGS

In the drawings:

FIG. 10 is a perspective view of the second embodiment for use in the hand of user with the belt in a coil position;

FIG. 11 is a perspective view of the second embodiment with the belt in an uncoiled position for use adjustable securement around the waist of a user;

FIG. 12 is a perspective view of a third embodiment of the apparatus of the present invention;

BEST MODE FOR CARRYING OUT THE INVENTION

Figure 1:
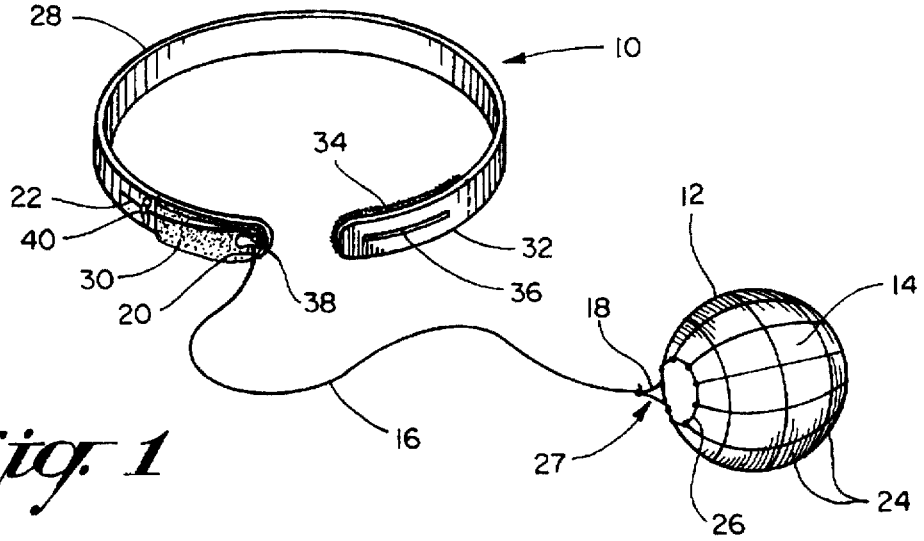
FIG. 1 is a perspective view of a first embodiment of the apparatus of the present invention.

Referring now to the drawings, FIGS. 1–6 illustrate a first embodiment of a soccer training apparatus 10. The apparatus 10 has a mesh soccer net 12 sized for encapsulating a soccer ball 14. Preferably, the mesh soccer net 12 is made from a strong lightweight material, such as nylon.

Figure 2:
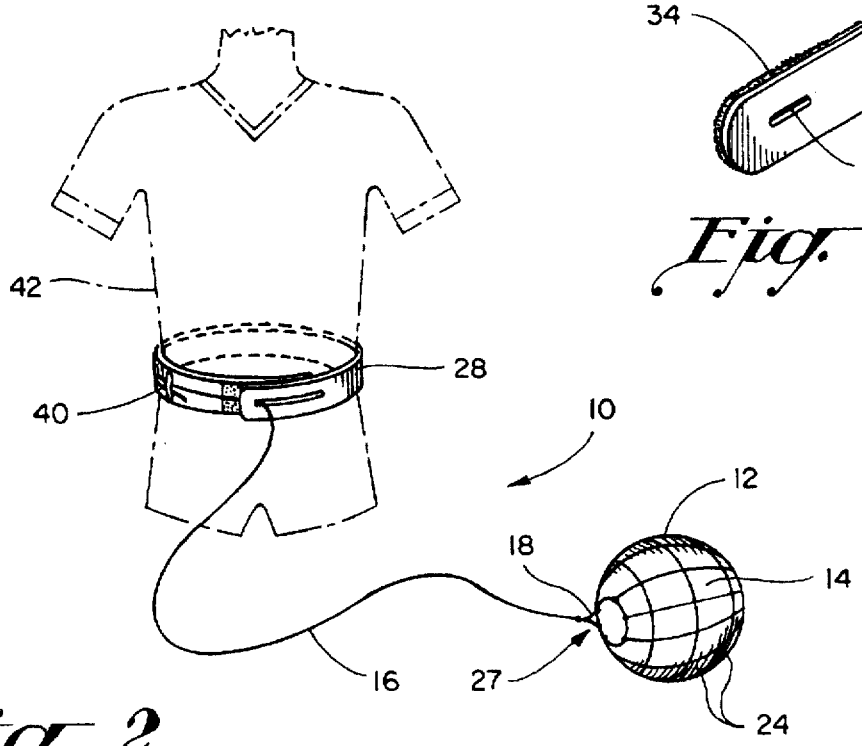
FIG. 2 is a perspective view of the apparatus of FIG. 1 being worn by a player.
Figure 4:
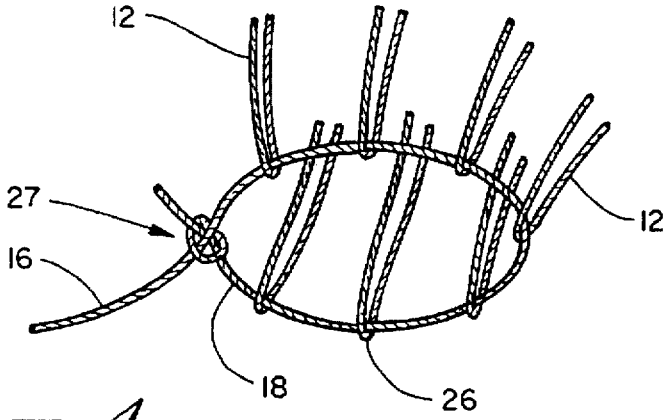
FIG. 4 is a fragmentary perspective view of the cord connected to the mesh soccer net.

A non-elastic tether or cord 16 has a first end or portion 18, a securing or second portion 20, and a second end 22. The first end 18 of the cord 16 is attached to the mesh soccer net 12. The cord 16 is physically attached at the first end 18 to the mesh soccer net 12 in a drawstring type fashion by gathering the mesh soccer net 12. This may be achieved in number of different configurations where the cord 16 is looped or threaded through a number of soccer net holes 24 around the edges of a net opening 26 of the mesh soccer net 12, as best illustrated in FIG. 4. As shown in FIGS. 1 and 2, the net opening 26 of the mesh soccer net 12 is then gathered or cinched closed, so that the mesh soccer net 12 encapsulates the soccer ball 14. The cord 16 is made from a strong lightweight material, such as nylon.

Preferably, the first end 18 of the cord 16 is slidably connected to the cord 16 for opening and closing of the mesh soccer net 12 in the drawstring type fashion described above. This may be achieved with the use of a slide type knot 27, a small ring or circle mounted on the very tip of the first end 18 of the cord 16, which would encircle the cord 16 in a slidable manner, or any other type of commonly known method used to secure the end of a drawstring.

Referring to FIG. 1, a waist belt 28 has an inner lapped belt end 30 and an outer lapped belt end 32. Hook and loop type fasteners or fastening means 34, such as VELCRO, are provided on confronting faces of the inner lapped belt end 30 and outer lapped belt end 32 for securing the inner lapped belt end 30 and outer lapped belt end 32 in detachable assembly together. The waist belt 28 itself may be formed of a double sided hook and loop fastening material, where one sided is mated for engagement of the other side. Alternatively, the waist belt is formed from a material, such as cotton or nylon, with the hook and loop fastening means 34 connected to the outer surfaces of the waist belt. The waist belt may also be formed from an elastic material.

Figure 3:
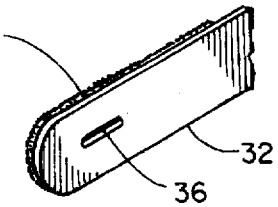
FIG. 3 is a fragmentary side view of an alternative embodiment of the outer lapped belt end of the first embodiment.

The outer lapped belt end 32 has a slot 36 of sufficient size for insertion of the cord 16 through it, as shown in FIG. 3. In a preferred manner of this embodiment, the slot 36 is elongated and of sufficient size to permit a net or soccer ball of any variety to be inserted through, as shown in FIG. 1.

Figure 5:
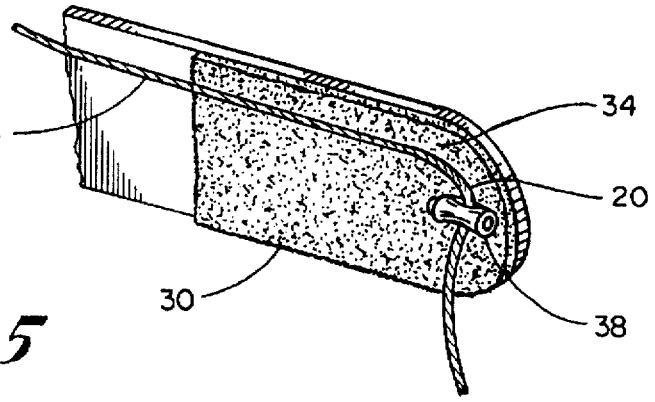
FIG. 5 is a fragmentary side view of the inner lapped belt end of the first embodiment.
Figure 6:
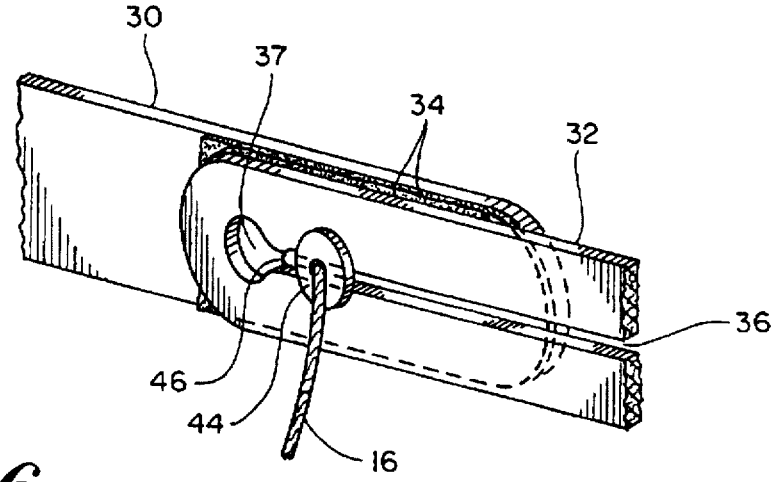
FIG. 6 is a fragmentary side view of an alternative embodiment for the inner and outer lapped belt ends of the first embodiment.

As best illustrated in FIG. 5, the inner lapped belt end 30 contains a length adjusting lock 38 for securing the securing portion 20 of the cord 16 to the inner lapped belt end 30. This length adjusting lock 38 can be of any sort of adjusting clamp, clasp, cord locking device, or spring loaded cord lock, all of which are known to one skilled in the art.

It is to be understood that in an alternative embodiment, the cord 16 could be permanently secured to the inner lapped belt end 30. In another embodiment shown in FIG. 6, a spring loaded retractable reel 44 having a reel lock 46 is provided instead of the length adjusting lock 38. The reel 44 is connected to the inner lapped belt end 30 at a bottom reel portion which is of a diameter less than the reel 44. The reel 44 is readily available commercially and is commonly used for dog leashes, tape measures, and extension cords. When lap engaging the outer lapped belt end 32 to the inner lapped belt end 30, the slot 36 may have a larger slot end 37 for easily inserting the reel 44 through the outer lapped belt end 32. Alternatively, a cord adjustment 90 as later described could be attached to the first portion of the cord 16.

A strap 40 is provided on the waist belt 28 for securing the second end 22 of the cord 16 to the waist belt 28 at a point on the waist belt 28 remote from where the inner lapped belt end 30 and outer lapped belt end 32 are engaged. This allows for a distance between the mesh soccer net 12 and the adjusting lock 38 to be varied. Preferably, the strap 40 has a hook and loop fastening means on one side thereof for attachment to the hook and loop fastening means on the inner lapped belt end 30. It is to be understood that other types of straps, hooks, or tying or securing means could equally be used in securing the second end 22 of the cord 16 to the waist belt 28.

In use, the apparatus 10 is placed around the waist of a player or user 42, as shown in FIG. 2. The soccer ball 14 which can be previously secured in the mesh soccer net 12 is then placed through the elongated slot 36 of the outer lapped belt end 32, along with the attached cord 16. It should be understood that the empty net 12 could also be placed through the slot 36 before the ball 14 is inserted within. Next, the outer lapped belt end 32 is adjustably secured to the inner lapped belt end 30. The adjusting lock 38 is exposed through elongated slot 36. When forces are exerted on the cord 16 during practice, the inner lapped belt end 30 will be pressed against the outer lapped belt end 32, which will continually keep the confronting faces of the hook and loop fastening means secured.

Referring now to FIGS. 7–11, a second embodiment of the soccer training apparatus is indicated generally by the numeral 50. A mesh soccer net 12 is provided. The net 12 is sized and configured for encapsulating the soccer ball 14 and loosely holding the soccer ball 14 within the mesh soccer net 12 enabling the encapsulated soccer ball 14 to freely rotate within, as previously shown.

Figure 9:
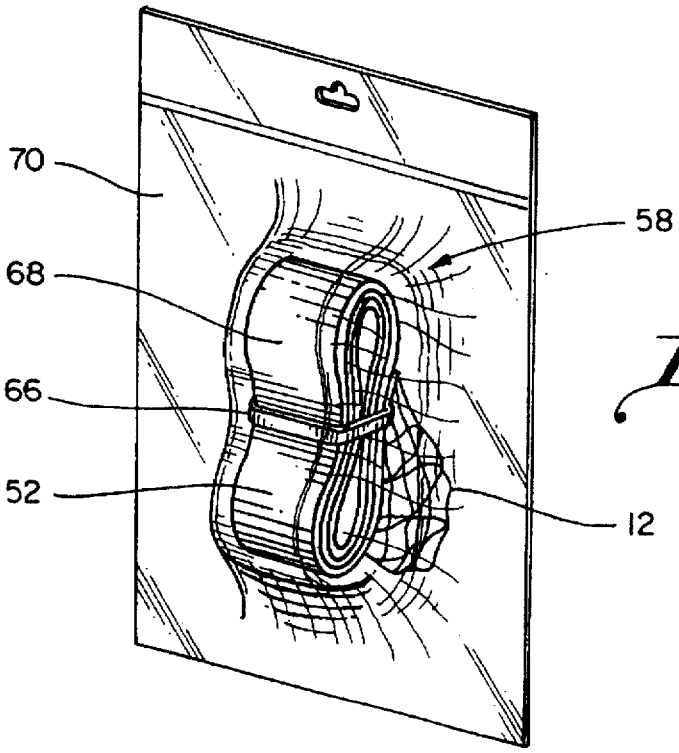
FIG. 9 is a perspective view of the second embodiment in packaged state with the belt in a coiled position.

A waist belt 52 has a first belt end 54 and a second belt end 56. The waist belt 52 is formed of a flexible or coilable material, such as nylon, so that the waist belt 52 is coilable into a coiled position 58 for holding in a hand 60 of a user 42, as illustrated in FIG. 10. A dual purpose clip or strap means 66 of conventional use is removably secured around a center portion 68 of the coiled waist belt 52 so that the waist belt 52 is retained in the coiled position 58 for packaging in a package 70, as shown in FIG. 9. The same strap means 66 used in packaging can then be used to hold the waist belt 52 in the coiled position 58 when held in the hand 60 of the user 42 during foot dribbling and juggling, as shown in FIG. 10, which allows for reduced manufacturing costs and simplified construction.

The waist belt 52 is uncoilable for configuration into an uncoiled position 62 for securement around a waist 64 of the user 42, as illustrated in FIG. 11. Hence, the coiled position 58 and uncoiled position 62 allow for two separate manners of operation of the apparatus.

Figure 7:
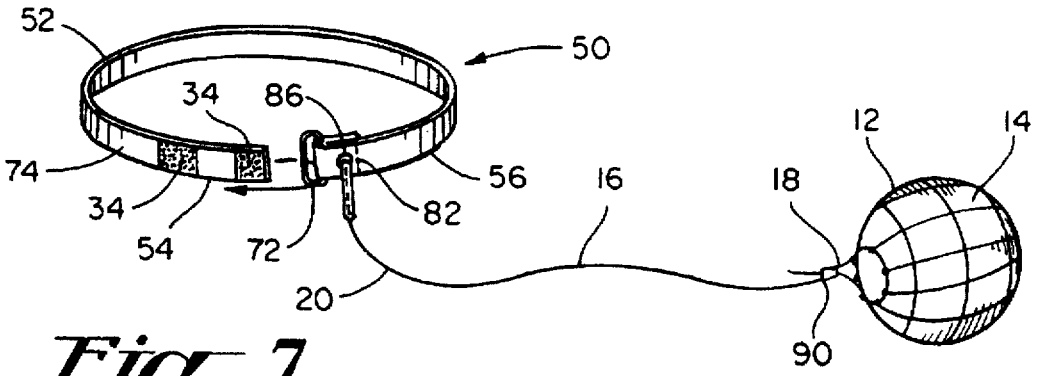
FIG. 7 is a perspective view of a second embodiment of the apparatus of the present invention.
Figure 8:
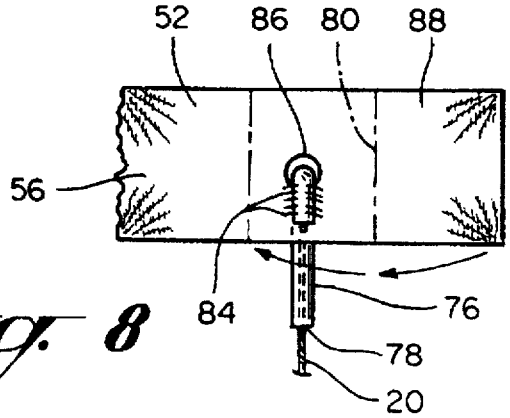
FIG. 8 is a fragmentary side view of the first belt end of the second embodiment.

A belt ring 72 formed of plastic or metal is connected to the second belt end 56. In construction, an outer end 88 of the second belt end 56 is folded along fold line 80 and then stitched along stitch line 82, as illustrated in FIGS. 7 and 8. The first belt end 54 has hook and loop fastening means 34 provided on an outer surface 24 of the first belt end 54 for adjustable and detachable assembly together when the first belt end 54 is inserted and looped through the belt ring 72. Preferably, the fastening means 34 are mated VELCRO sections stitched to the outer surface 24 of the waist belt 52.

The cord 16 has a first portion 18 attached to the mesh soccer net 12. An elongated plastic tube 76 has an aperture 78 extending therethrough. The second portion 20 of the cord 16 being extended through the aperture 78. The first belt end has a hole 86 for insertion of the tube 76 and cord 16, with the tube 76 and cord 16 being secured to the waist belt by stitches 84 or other suitable means enabling the tube 76 to provide a protective covering for the second portion 20 of the cord 16. With the second portion 20 of the cord 16 operatively connected to the waist belt 52, the mesh soccer net 12 is left carrying the soccer ball 14 suspended from the waist belt 52. A cord adjustment 90 of conventional design is connected to the cord 16 allowing for manual adjustment of the length of the cord 16 between the mesh soccer net 12 and waist belt 52. Since the cord adjustment 90 creates a secured looped cord portion that is movably inserted through the net, the cord adjustment 90 provides a dual function of both adjusting the length of cord and creating a looped first portion 18 that can engage the net 12 in manner to hold the net in closed position but at the same time enabling the encapsulated soccer ball to freely rotate within.

Referring now to FIGS. 12–17, a third embodiment of the soccer training apparatus is indicated generally by the numeral 92. The net 12 is sized and configured for encapsulating the soccer ball 14 and loosely holding the soccer ball 14 within the mesh soccer net 12 enabling the encapsulated soccer ball 14 to freely rotate within, as in the previous embodiments.

The waist belt 52, net 12 and cord 16 are similar to that previously described and shown in the second embodiment. However, this embodiment differs with respect to the manner of attachment of the cord to the waist belt.

Figure 16:
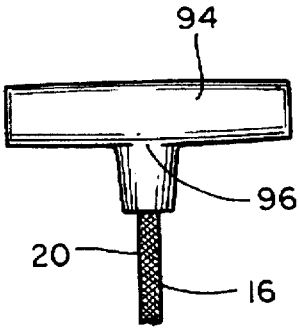
FIG. 16 is a perspective view of a hand grip for use with the third embodiment.
Figure 17:
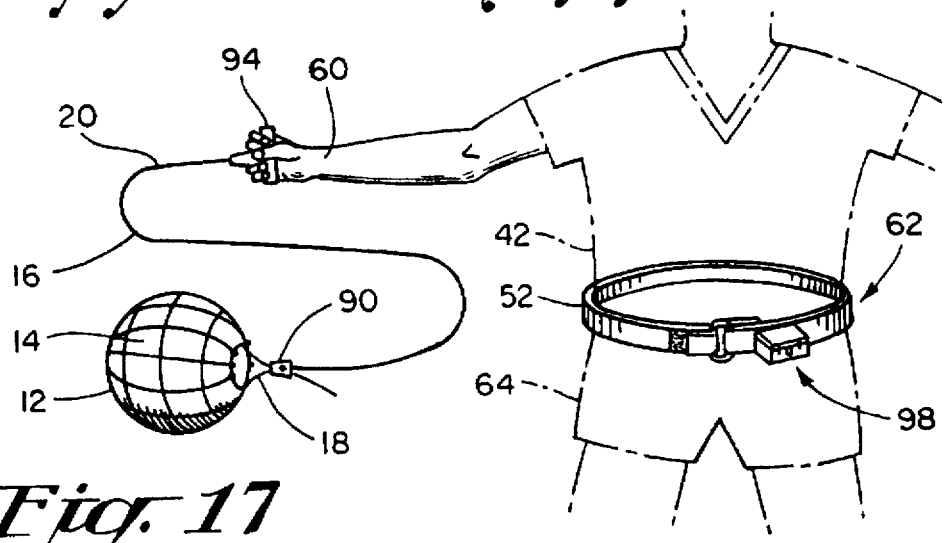
FIG. 17 is a perspective view of the embodiment of the present invention.

In FIG. 16, a rubber or plastic hand grip 94 is shown. The hand grip 94 is T-shaped to allow the hand 60 of a user 42 to firmly grasp the hand grip 94, as shown in FIG. 17. It should be understood that other shapes of the hand grip 94 could also be employed. The second portion 20 of the cord 16 is connected to the hand grip 94 at a center portion 96 of the hand grip 94.

Figure 14:
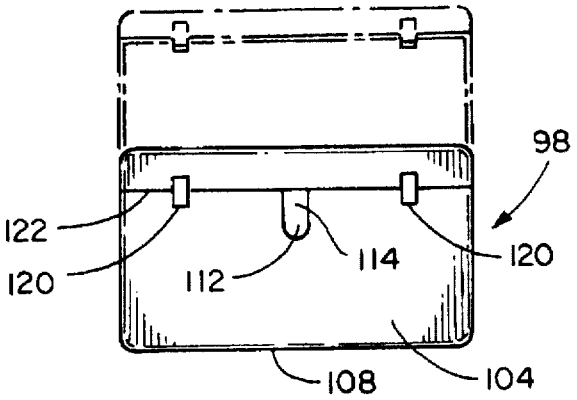
FIG. 14 is a front view of the belt box for use with the third embodiment.
Figure 13:
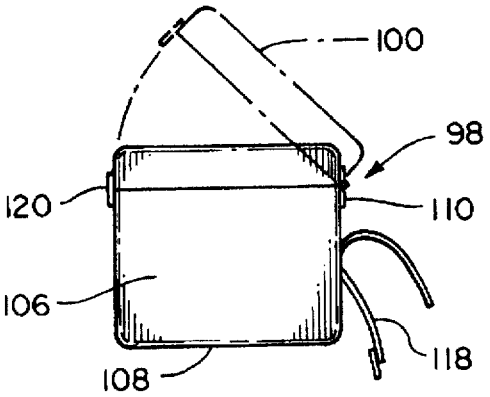
FIG. 13 is a side view of a belt box for use with the third embodiment.
Figure 15:
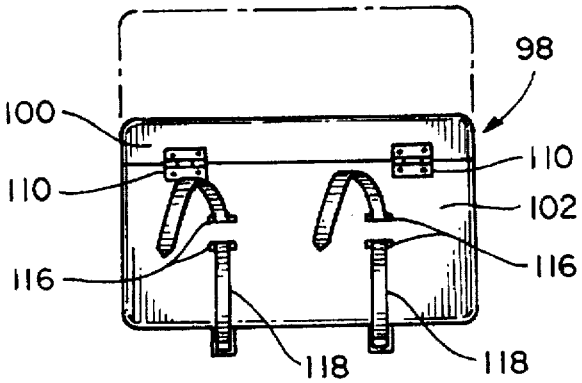
FIG. 15 is a rear view of the belt box for use with the third embodiment.

To allow a user 42 to selectively practice with cord 16, net 12 and ball 14 suspended from the hand 60 or the waist 64, the hand grip 94 is detachably secured to the waist belt 92. Referring to FIGS. 13–15, a retaining box 98 has a top side 100, a rear side 102, a front side 104, end sides 106, and a bottom side 108. The box 98 being preferably formed of plastic and sized to encapsulate the hand grip 94. The top side 100 being pivotally secured to the rear side 102 by hinges or crimped edges 110. The front side 104 has a cord indention 112, as shown in FIG. 14. The sides of the box 98 define a cavity 114 therewithin in communication with the cord indention 112 so that the hand grip 94 can be selectively secured within the cavity 114 of the retaining box with the cord 16 extending through the cord indention 112, as shown in FIG. 12, leaving the mesh soccer net 12 carrying the soccer ball 14 suspended from the waist belt 92.

Referring to FIGS. 12 and 15, the rear side 102 is connected to the waist belt 92. The rear side has securing holes 116 for attaching the box 98 to the waist belt 92 by suitable means, such as by stitching through the holes or with a pair of box straps 118 of suitable type.

The top side 100 of the box 98 has extending tabs 120 formed integral with the top side for releasably securing with an upper edge 122 of the front side 104 when the top side 100 is pivoted into a closed or secured position to enable the hand grip 94 to be secured within the cavity 114 of the box 98.

Figure 18:
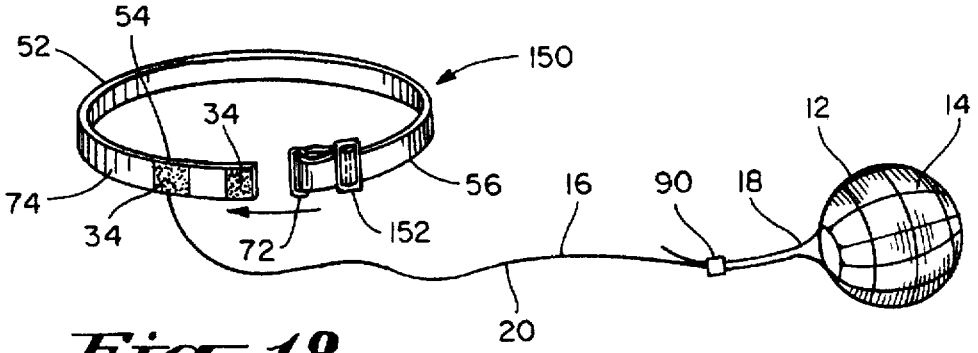
FIG. 18 is a perspective view of a fourth embodiment of the apparatus of the present invention.

Referring to FIG. 18, a fourth preferred embodiment of the soccer training apparatus is indicated by the numeral 150. This preferred embodiment is similar to the embodiment shown in FIG. 7, except for the noted differences which include the inclusion of an adjustment ring 152 slidably mounted to the second belt end to allow a user to adjustably vary the length of the waist belt 52.

In FIG. 7, adjustment was made by virtue of the first belt end 54 having hook and loop fastening means 34 which would allow for a varied length of the first belt end 54 to be looped through the belt ring 72 for detachable assembly.

In FIG. 18, it can be seen that the first belt end 54 is similarly constructed for looped engagement about belt ring 72. The adjustment ring 152 is preferably formed of plastic and has a front member 154, a center member 156, and a rear member 158, as best illustrated in FIG. 20. In construction, an outer end 88 of the second belt end 56 is folded over and inserted or looped around the center member 156 of the adjustment ring 152 and stitched along stitch line 158 for fixedly securing the ring 152 to the outer end 88. The second belt end 56 is looped about belt ring 72 and is inserted through the adjustment ring 152 for slidable movement under the front member 154, over the center member 156, and under the rear member 158, as shown in FIG. 19.

Figure 19:
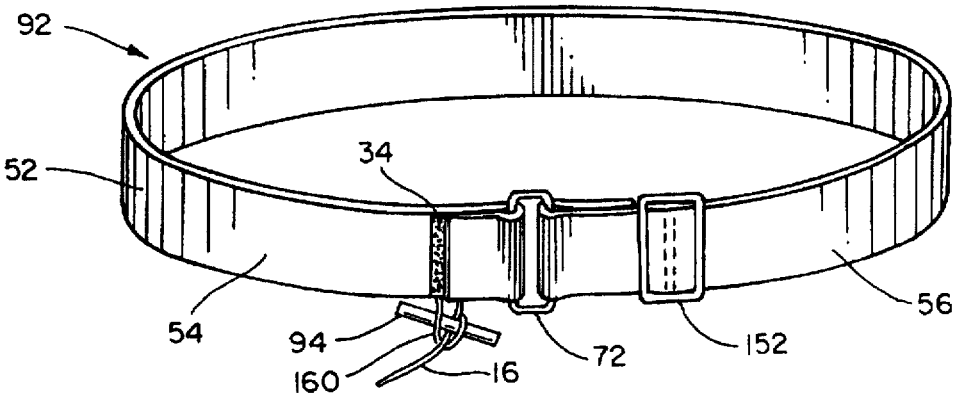
FIG. 19 is a perspective view of a fifth embodiment of the apparatus having a detachable assembly for securing a hand grip to the waist belt.
Figure 20:
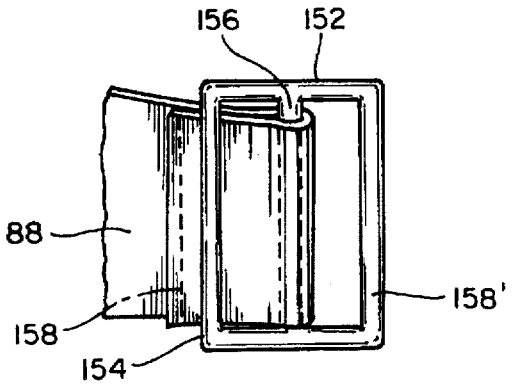
FIG. 20 is a perspective view of an adjustment ring attached to an end of the waist belt.

While FIGS. 18 and 19 are similar with respect to the use of the adjustment ring 152, FIG. 19 illustrates a fifth embodiment of the present invention which differs from FIG. 18 with respect to the manner of attachment of the cord to the waist belt 52 and instead employs a system as previously described and shown in FIGS. 12–17 for detachably securing a hand grip 94 to the waist belt 52.

Referring to FIG. 19, the means for detachably securing the hand grip 94 includes a snap hook 160 connected to the waist belt 52. The snap hook is sized and configured for removably receiving the second portion of the cord so that the hand grip 94 can be suspended from the waist belt 54. It should be understood that other hooks, loops, swivels and attachment assemblies could also be used. For example, retaining box 98, shown in FIG. 12, could be equally be used in replacement of snap hook 160.

Figure 21:
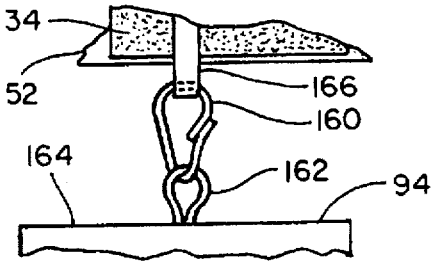
FIG. 21 is an enlarged fragmentary view of a hand grip attached to the waist belt.

Referring to FIG. 21, the hand grip 94 has a loop member 162 attached to an outer side 164 of the hand grip 94. The loop member could be a separate member attached to the hand grip 94 or could be formed from a portion of the cord 16 inserted through and extending from the hand grip 94. The loop member 162 is then securable on the snap hook 160 for securing the hand grip 94 to the waist belt 52. The snap hook 160 is attached to the waist belt by engaging a flexible member 166 which is secured to the belt 52. It should be understood that other manners of attachment are equally within the scope of this invention. By attaching the hand grip 94 in this fashion compared to that shown in FIG. 19, securement is made without involvement of a forward portion of the cord 16.

It should be understood that other combinations of features of the above-described embodiments are possible.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A soccer training apparatus, comprising:

(a) a mesh soccer net sized and configured for encapsulating a soccer ball and loosely holding the soccer ball within the mesh soccer net enabling the encapsulated soccer ball to freely rotate within;

(b) a waist belt adapted for securement around a waist of a user;

(c) a cord having a first portion operatively attached to the mesh soccer net; and (d) a hand grip connected to the second portion of the cord and means for detachably securing the hand grip to the waist belt so that a user may selectively hold the hand grip in a user's hand or secure the hand grip to the waist belt leaving the mesh soccer net carrying the soccer ball suspended from the waist belt.

2. The apparatus of claim 1, wherein the means for detachably securing the hand grip to the waist belt comprises a hook member attached to the waist belt, the hook member being adapted for detachably connecting with the hand grip.

3. The apparatus of claim 1, wherein the means for detachably securing the hand grip to the waist belt comprises a retaining box operatively connected to the waist belt, the retaining box being sized for removably securing the hand grip therein.

4. The apparatus of claim 1, wherein the means for detachably securing the hand grip to the waist belt comprises a retaining box having a top side, a rear side, and a front side, the rear side being operatively connected to the waist belt, the top side being pivotally secured to the rear side, the front side having a cord indention, the box defining a cavity therewithin in communication with the cord indention so that the hand grip can be selectively secured within the cavity of the retaining box with the cord extending through the cord indention, leaving the mesh soccer net carrying the soccer ball suspended from the waist belt.

5. The apparatus of claim 1, further comprising cord adjustment means connected to the cord for manually adjusting the length of the cord and securing the first portion of the cord in a looped configuration for attachment with the net.

6. A soccer training apparatus, comprising:

(a) a mesh soccer net sized and configured for encapsulating a soccer ball and loosely holding the soccer ball within the mesh soccer net enabling the encapsulated soccer ball to freely rotate within;

(b) a waist belt adapted for securement around a waist of a user, the waist belt having means for adjustably varying the length of the waist belt;

(c) a hand grip;

(d) a cord having a first portion attached to the mesh soccer net, the cord having a second portion connected to the hand grip;

(e) means for detachably securing the hand grip to the waist belt; and (f) cord adjustment means connected to the cord for manually adjusting the length of the cord between the mesh soccer net and waist belt.

7. The apparatus of claim 6, wherein the means for detachably securing the hand grip to the waist belt comprises a hook member attached to the waist belt, the hook member being sized and configured for removably attaching the hand grip thereto for suspending the hand grip from the waist belt.

8. The apparatus of claim 6, wherein the means for detachably securing the hand grip to the waist belt comprises a retaining box operatively connected to the waist belt, the box having an aperture and defining a cavity therewithin in communication with the aperture so that the hand grip can be selectively secured within the cavity of the retaining box with the cord extending through the aperture, leaving the mesh soccer net carrying the soccer ball suspended from the waist belt.

9. A soccer training apparatus, comprising:

(a) a mesh soccer net sized and configured for encapsulating a soccer ball and loosely holding the soccer ball within the mesh soccer net enabling the encapsulated soccer ball to freely rotate within;

(b) a waist belt having first and second belt ends detachably connectable to one another for securement around a waist of a user;

(c) a hand grip;

(d) a cord formed of a non-elastic material, the cord having a first portion attached to the mesh soccer net in a drawstring type fashion by gathering the mesh soccer net, the cord having a second portion operatively connected to the hand grip;

(e) means for detachably securing the hand grip to the waist belt; and (d) cord adjustment means connected to the cord for manually adjusting the length of the cord between the mesh soccer net and waist belt and securing the first portion of the cord in a looped configuration for attachment with the net.

10. The apparatus of claim 9, wherein the means for detachably securing the hand grip to the waist belt comprises a hook member attached to the waist belt, the hook member being adapted for removably attaching the hand grip thereto for suspending the hand grip from the waist belt.

* * * * *